US005488757A

United States Patent [19]

Cohen et al.

[11] Patent Number: 5,488,757

[45] Date of Patent: Feb. 6, 1996

[54] COUNTERBALANCE DEVICE FOR MAIL PROCESSING SYSTEM COVER

[75] Inventors: Steven E. Cohen, Seymour, Conn.; Arnold T. Eventoff, Pleasantville, N.Y.; James A. Salomon, Cheshire, Conn.

[73] Assignee: Pitney Bowes Inc., Stamford, Conn.

[21] Appl. No.: 312,590

[22] Filed: Sep. 27, 1994

[51] Int. Cl.[6] ..... E05F 1/08; E05F 1/14

[52] U.S. Cl. ..... 16/289; 16/296; 16/280; 292/17; 292/338

[58] Field of Search ..... 16/289, 286, 296, 16/293, 280, 281; 292/338, DIG. 4, 17

[56] References Cited

U.S. PATENT DOCUMENTS

| | | | |
|---|---|---|---|
| 683,887 | 10/1901 | Bedell | 16/289 |
| 2,922,184 | 1/1960 | Bogater | 16/289 |
| 3,906,587 | 9/1975 | Little | 16/289 |
| 4,571,775 | 2/1986 | Leonard . | |
| 4,876,956 | 10/1989 | Riley et al. . | |

OTHER PUBLICATIONS

Counterbalance advertising brochure, undated.

Counterbalance torque Is Adjustable Compact, Frank Yeaple, Design News, Nov. 7, 1985.

Counterbalance Advertising Letter and Brochure, undated.

*Primary Examiner*—P. Austin Bradley
*Assistant Examiner*—Adesh Bhargava
*Attorney, Agent, or Firm*—Steven J. Shapiro; David E. Pitchenik; Melvin J. Scolnick

[57] ABSTRACT

A counterbalance device for a mail processing system includes a cover; a base; a support arm fixedly mounted to one of the cover and the base and articulately mounted to the other of the cover and the base such that the cover and the base pivot relative to each other; a device for counterbalancing the one of the cover and the base to create a predetermined force profile throughout a full range of pivoting movement of the one of the cover and the base from a closed position to a fully opened position relative to the other of the cover and the base. The predetermined force profile represents the net force acting on the one of the cover and the base at each point in the full range of pivoting movement. The counterbalancing device includes a cam operatively connected to pivot with the one of the cover and base, a follower arm pivotally connected to the other of the cover and the base, a roller mounted on the follower arm and a biasing means mounted to pivot with the one of the cover and the base and being connected to the follower arm for biasing the roller against the cam such that during pivoting of the one of the cover and the base through the full range of pivoting movement the roller follows a shape of the cam.

16 Claims, 5 Drawing Sheets

COUNTERBALANCE DEVICE FOR MAIL PROCESSING SYSTEM COVER

BACKGROUND OF THE INVENTION

I. Field of the Invention

The invention relates to a counterbalance device and in particular to a counterbalance device for an articulated cover of a mail processing system.

II. Discussion of the Related Art

Mail processing systems for moving and printing postage on various pieces of mail are commonly known and often include a feeder module which feeds mailpieces to a mailing machine module. The mailing machine module includes either a mechanical or electronic postage meter which prints postage indicia and/or slogans on the mailpiece passing therethrough. The postage meter is usually mounted within a base portion of the maining machine module, as for example, is set forth in U.S. Pat. No. 4,876,956, issued to Riley, et al., which is hereby incorporated by reference. A lid or cover is articulately connected to the base portion of the mailing machine module and covers and protects the postage meter when in a closed position. The cover may also include function keys and displays through which information is communicated to and from the postage meter.

It is often the case however, that the cover is quite large and of significant weight. As the cover is moved through its full range of motion from a closed position to a fully opened position, the effective weight of the cover changes due to the angle it makes with respect to the base. Thus, the largest amount of force required to move the cover toward the fully opened position typically occurs when the cover is in the closed horizontal position. On the other hand, when the cover is substantially vertical to the base, a minimal amount of force is required to move it toward either the closed or opened positions. Beyond the vertical position, the effective weight of the cover once again continues to increase as the cover is moved toward the fully opened position. Due to the effective weight of the cover, there is a tendency for the cover to slam open with considerable force. The slamming open of the cover can ultimately cause damage to the cover, the base, and/or the articulating connection between the cover and the base. Consequently, counterbalance devices have been employed which are effective to minimize the differences in apparent weight of the cover as it moves from one operative position to another. Generally, these devices are effective to exert a force on the cover at any given intermediate position which is substantially equal and opposite to the effective weight of the cover so that when the cover is released in an intermediate position, the cover tends to stay in that intermediate position.

Known physical counterbalancing devices include an added, appropriately located weight on the opposite side of the cover pivotal axis. However, this type of counterbalance device adds a significant amount of weight and space requirements and increases the cost of the system. Other counterbalance devices utilize hydraulic or automatic cylinders. However, these counterbalance devices are costly, complex and subject to significant-maintenance problems. In addition, while the use of hydraulic shock absorbers or gas springs have been proposed, they are very expensive, present substantial space problems, and typically obstruct side access when the cover is lifted.

U.S. Pat. No. 4,571,775, issued to Leonard, discloses a counterbalance device which includes a complicated torsion member formed by a plurality of rods that are surrounded by a sleeve. The torsion member interacts with a cam via a follower arm and a follower roller in order to counterbalance the cover. The apparatus described in U.S. Pat. No. 4,571,775 is a complicated structure which is costly to produce and occupies a great deal of space. When the torsion member counterbalance device of U.S. Pat. No. 4,571,775 is incorporated within the base of a mailing module, a significant amount of space is utilized which cannot, for example, be used to incorporate additional stiffeners in the base. Thus, the base would have to be made out of stronger materials or enlarged and stiffened in a different manner.

Additionally, the torsion member apparatus of U.S. Pat. No. 4,571,775 focuses on providing neutral counterbalancing of the cover. By neutral counterbalancing, it is meant that the forces acting on the cover are in equilibrium at any point over the full range of movement of the cover such that the cover would remain in any position in which it was released. However, such a neutral force profile is not always desirable and a counterbalance device which is capable of easily varying the force profile exerted on the cover is needed to, for example, provide a force acting to keep the cover shut in the closed position while also providing a force acting to move the cover toward the closed position when it is in the fully opened position, thereby preventing the cover from slamming open under its own weight.

SUMMARY OF THE INVENTION

It is an object of the invention to provide a counterbalance device for a cover which is simple in construction.

It is a further object of the invention to provide a counterbalance device which can readily be adapted to create a varying force profile acting on the cover.

The above objects are met by providing a counterbalance device for a mail processing system, including a cover; a base; a support arm fixedly mounted to one of the cover and the base and articulately mounted to the other of the cover and the base such that the cover and the base pivot relative to each other; means for counterbalancing the one of the cover and the base to create a predetermined force profile throughout a full range of pivoting movement of the one of the cover and the base from a closed position to a fully opened position relative to the other of the cover and the base, the predetermined force profile representing the net force acting on the one of the cover and the base at each point in the full range of pivoting movement. The counterbalancing means includes a cam operatively connected to pivot with the one of the cover and the base, a follower arm pivotally connected to the other of the cover and the base, a roller mounted on the follower arm and a biasing means mounted to pivot with the one of the cover and the base and being connected to the follower arm for biasing the roller against the cam such that during pivoting of the one of the cover and the base through the full range of pivoting movement the roller follows the shape of the cam.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
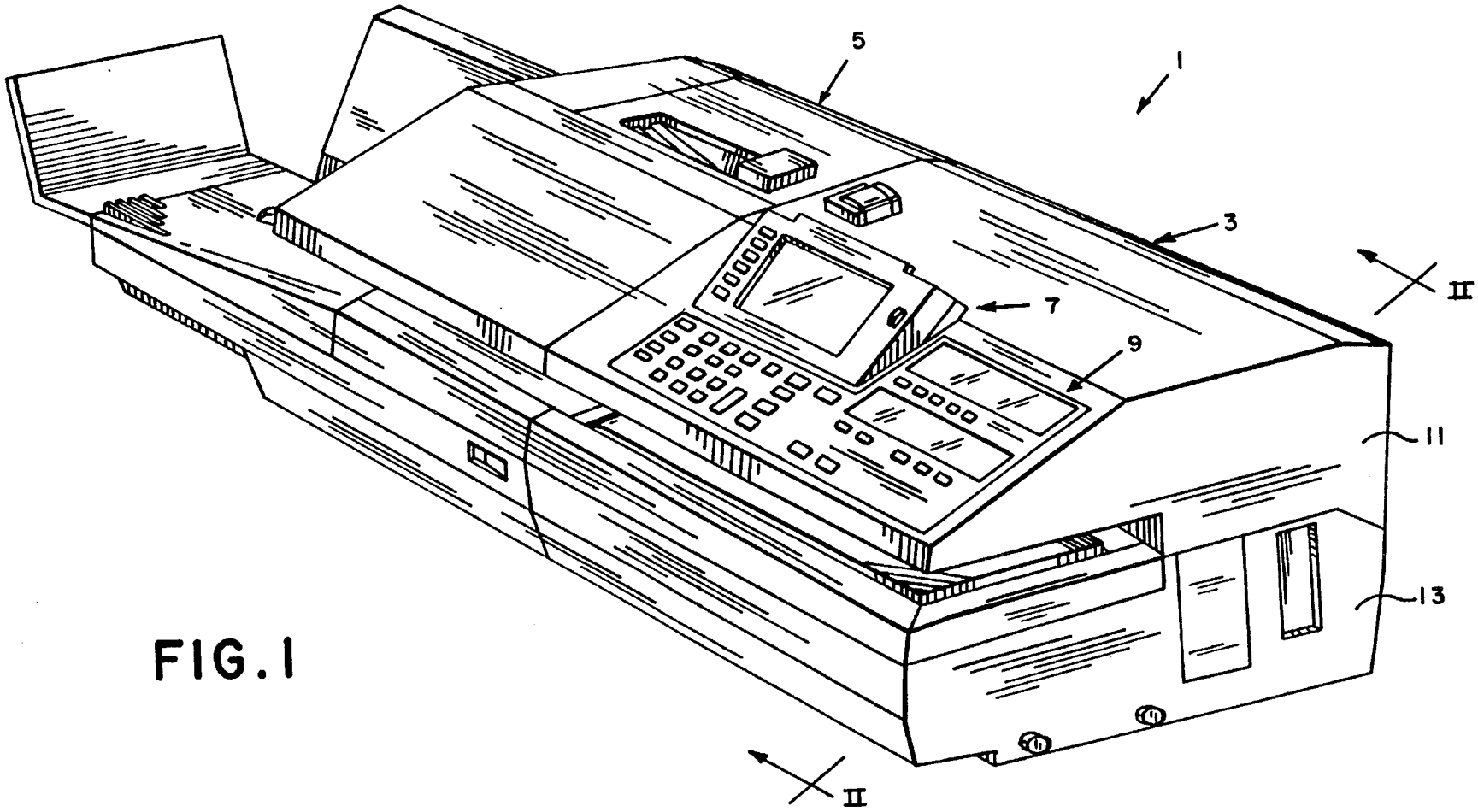
FIG. 1 is a perspective view of a mail processing system including the present invention.

Referring to FIG. 1, in a preferred embodiment of the present invention, a mail processing system, generally indicated as 1, includes a mailing machine module 3 in combination with a feeder module 5. The mailing machine module 3 includes a main display keyboard entry system, generally indicated as 7, and additional displays and input keys, generally indicated as 9. The mail processing system 1 also includes a cover 11 which is pivotably mounted to a base 13. The base 13 houses an electronic postage meter (not shown) having a printing die for printing indicia and/or slogans on a mailpiece passing through the postage meter. Base 13 also houses a printing platen which interacts in a known manner with the printing die of the postage meter to produce the indicia and/or slogan on the mailpiece. Such a postage meter, platen and printing die is shown in the aforementioned U.S. Pat. No. 4,876,956.

Figure 2:
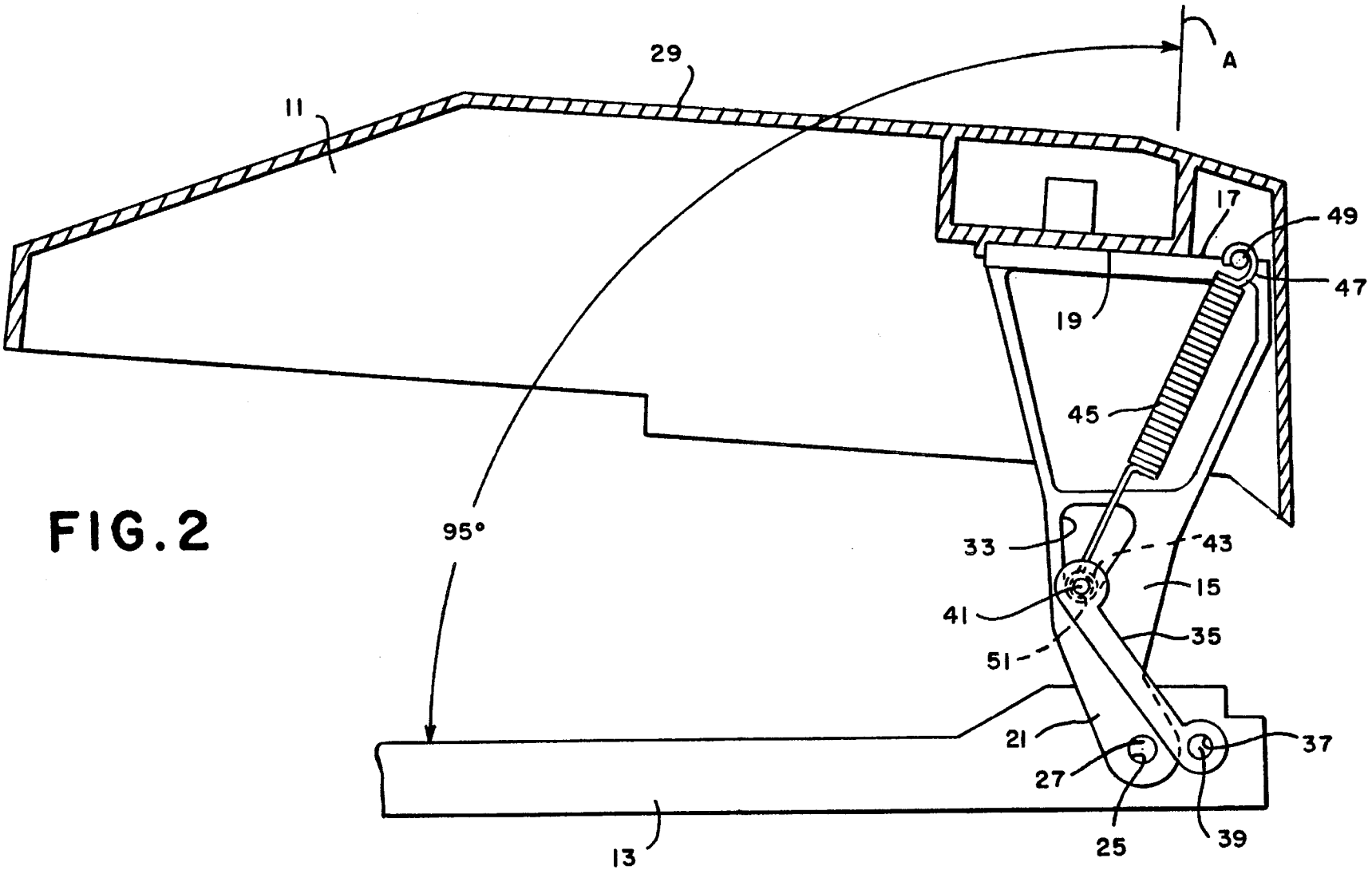
FIG. 2 is an enlarged cross-sectional view of the closed cover as viewed along II, II of FIG. 1, and showing a portion of the base.

FIG. 2 shows cover 11 connected to base 13 via a cover arm 15. A top surface 17 of cover arm 15 is fixedly connected to a bottom surface 19 of cover 11 in a conventional manner. A lower end 21 of cover arm 15 is pivotally connected to base 13 via a conventional pin and sleeve arrangement. Sleeve 25 is integrally formed within cover arm 15 and fits around a pin 27 in a conventional manner, thereby allowing cover arm 15 to freely rotate about pin 27. It is to be noted that in the closed position, a first portion 29 of the top surface of cover 11 forms an angle of 5 degrees relative to the approximately horizontal base 13. Put in another way, line "A", which is perpendicular to first portion 29, forms an angle of 95 degrees relative to base 13.

In the preferred embodiment, cover arm 15 has a cam 33 integrally formed therein. While cam 33 is shown as being an integral part of cover arm 15, it could also be a separate cam coupled to the covey arm 15 such that the cam is forced to pivot with the cover arm 15.

A follower arm 35 has a sleeve 37 formed therein through which a first follower pin 39 passes and thereby connects follower arm 35 to base 13 in an articulating manner. The follower arm 35 therefore is free to pivot about first follower pin 39.

A second follower pin 41 passes through and is connected to follower arm 35 in a conventional manner. Second follower pin 41 has an undercut portion (not shown) therein for a purpose to be discussed in more detail below. A follower arm roller 43 is conventionally mounted on second follower pin 41 to be rotatable thereabout. In the closed position of cover 11, follower arm roller 43 is shown as being disposed within cam 33 at approximately a lowermost portion thereof. However, as cover arm 15 is rotated in a clockwise direction between the fully closed position of cover 11 and a fully opened position of cover 11 (see FIG. 2), follower arm roller 43 is forced to follow the surface profile of cam 33 due to its relationship with extension spring 45.

Extension spring 45 has a first arcuately shaped end 47 which is hooked around a projecting stub 49 of cover arm 15. A second arcuately shaped end portion 51 of extension spring 45 is hooked around the undercut portion (not shown) of second follower pin 41, thereby operatively connecting cover arm 15 to cam follower arm 35 and follower arm roller 43.

Figure 3:
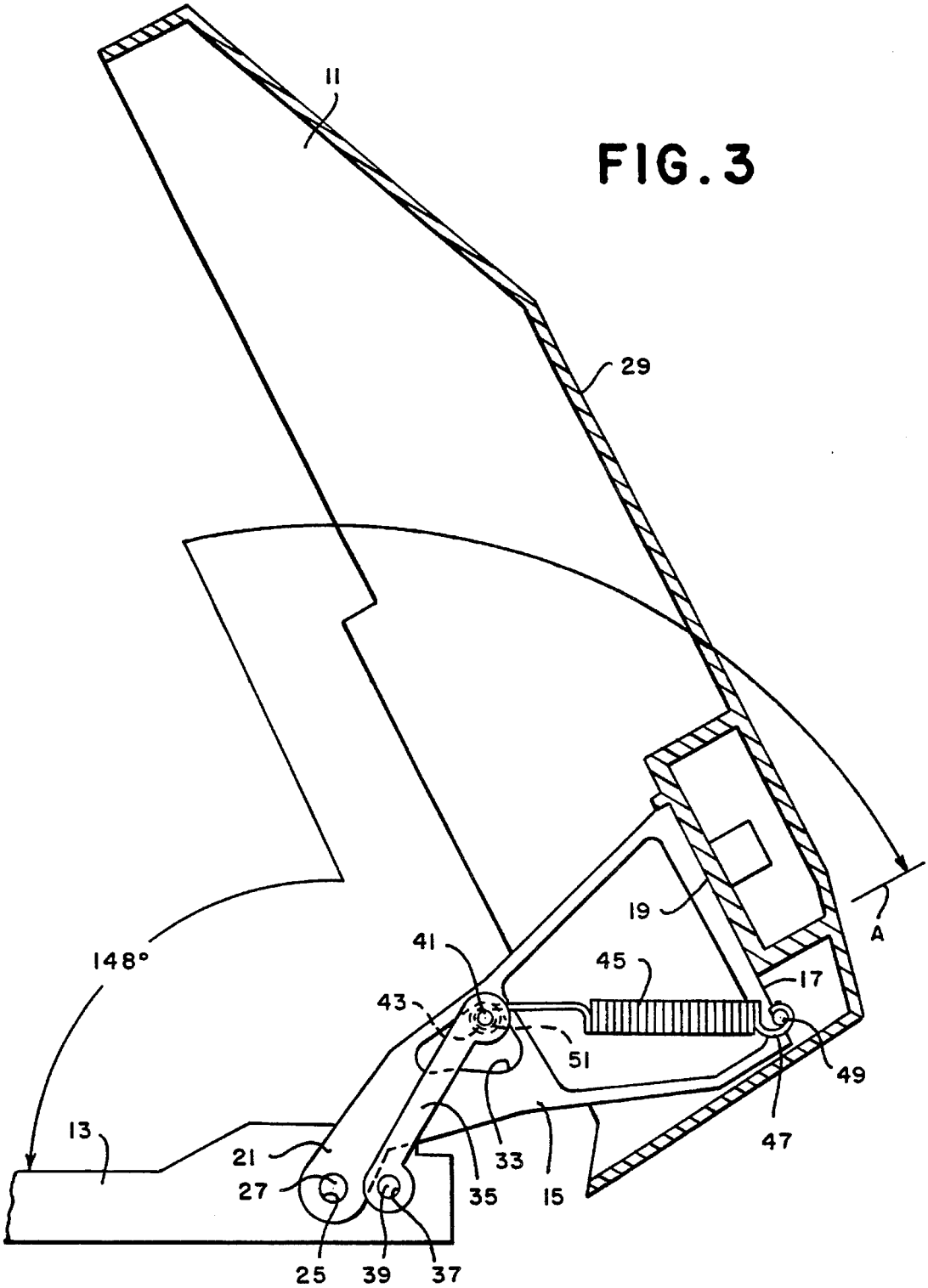
FIG. 3 is a view similar to FIG. 2 but showing the cover in the fully opened position.

Referring to FIG. 3, cover 11 is shown in its fully opened position with Line "A" forming an angle with base 13 of 148 degrees. In the fully opened position, the follower arm roller 43 is positioned at a different location along the cam 33 then that of FIG. 1. That is, as cover arm 15 and cover 11 are rotated clockwise from the closed to the fully opened position, extension spring 45 pivots therewith at stub 49 and biases follower arm roller 43 against cam 33 such that follower arm roller 43 moves along the surface of cam 33 in a counterclockwise direction from its position in FIG. 1 to its position in FIG. 2. Correspondingly, follower arm 35 is forced to rotate about first follower pin 39 in a clockwise direction. As cover 11 moves from the closed position to the fully opened position, the length of spring 35 is constantly changing due to its relative positional relationship with follower arm 45, second follower pin 41, and follower cam roller 43 such that the biasing force attributable to spring 45 and acting upon cover 11 is constantly changing. Thus, the effective weight of cover 11 at any individual position throughout the full range of motion of cover 11 will be equivalent to the sum of the force produced by the weight of cover 11 itself and the force that spring 45 imparts to the cover in that particular position. It is to be noted that in the preferred embodiment there is a point at which follower arm 35 actually rotates in opposition to the opening rotation of cover 11 such that the biasing force attributable to spring 45 acts to close the cover 11.

Figure 4:
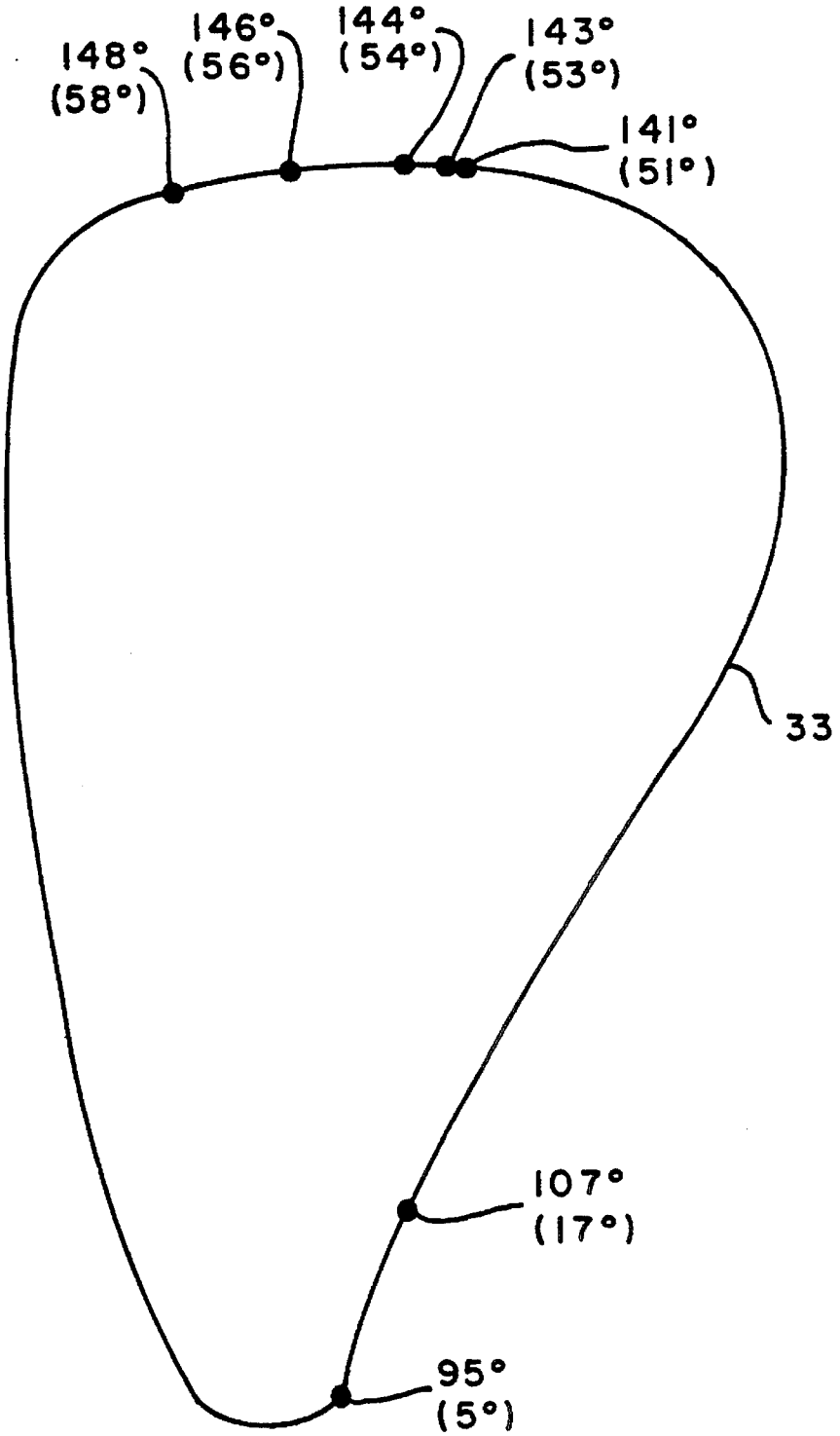
FIG. 4 is a schematic representation of the inventive cam profile and identifies specific points along the cam profile correlating to the graph of FIG. 5 showing where the follower roller is positioned on the cam at specific angular positions of the cover relative to the base.

FIG. 4 schematically shows an enlarged view of the profile of cam 33 oriented as shown in FIG. 2. FIG. 4 shows approximately where follower arm roller 43 is forced against cam 33 by extension spring 45 as cover 11 moves from its fully closed position (line "A" 95 degrees from base 13) to its fully open position (line "A" 148 degrees from base 13). Additional intermediate positions of follower arm roller 43 along cam 33 as they relate to specific angular positions of cover 11 are also shown and their relevance will be discussed in more detail below. Moreover, the angles in parenthesis represent the angular displacement of the first portion 29 of the cover relative to base portion 13. Thus, it is easily seen that the cover rotates a total of approximately 53 degrees (95 degrees to 148 degrees) from the closed position to the fully opened position.

Figure 5:
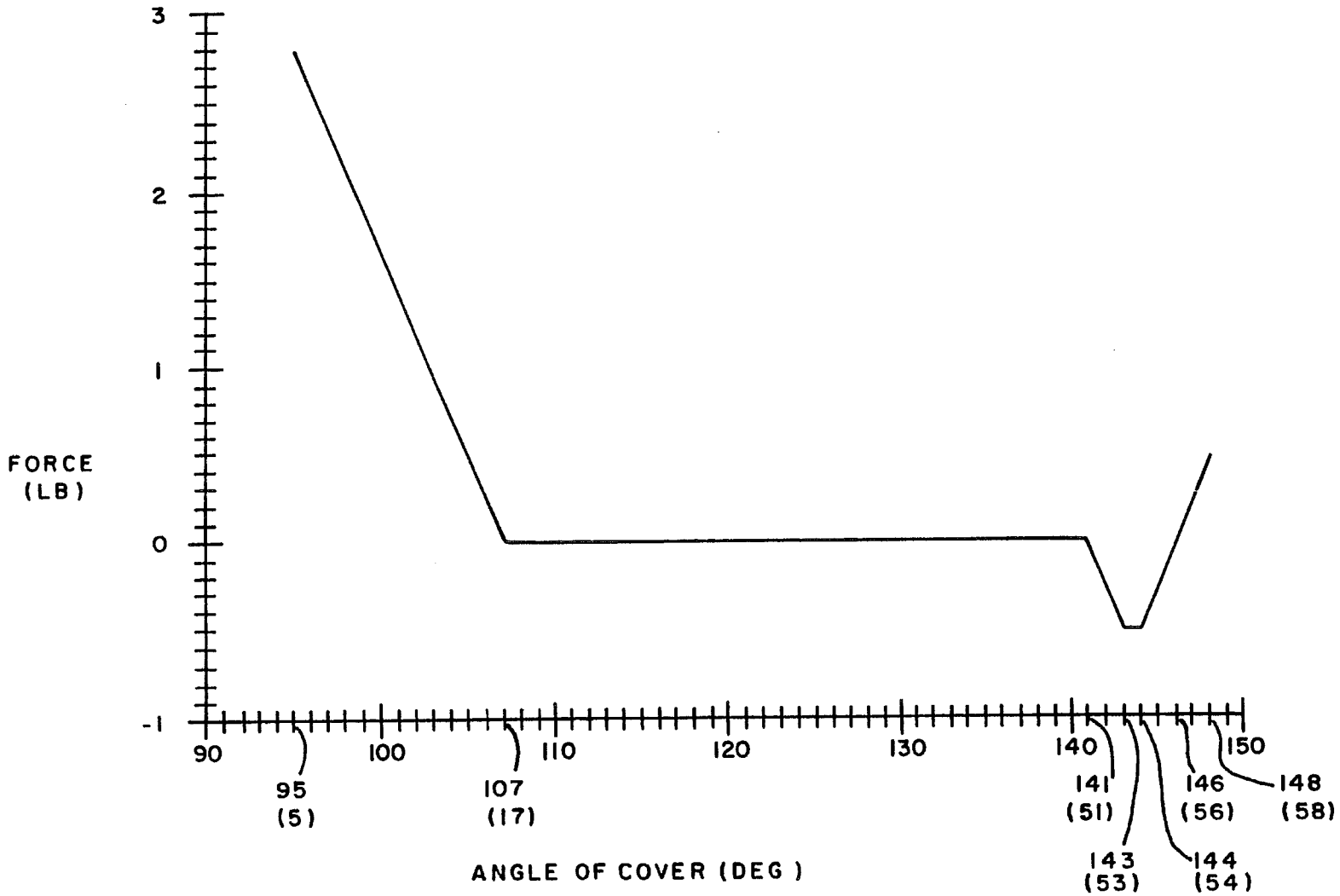
FIG. 5 is a graph showing the force profile acting on the cover as it relates to the angle of the cover relative to the base.

In the preferred embodiment, cam 33 has been designed to ensure that a predetermined force profile acting on the cover 11 is obtained at each and every point throughout its full range of motion. The term "force profile acting on the cover" as used herein means that amount of force being exerted on the cover at any point during its full range of motion due to the sum of the forces attributable to the weight of cover 11 and the biasing force of spring 45. Put in another way, it also represents the threshold force which an operator will have to exert in order to move cover 11 from the direction of the closed cover position to the fully opened position at each and every point. Regarding the preferred embodiment, the Applicants have found that a preferred "force profile acting on the cover" is that which is set forth in FIG. 5. In FIG. 5, the abscissa represents the angle (line "A" relative to base (13)) the cover 11 makes with base 13, while the ordinate represents the overall force being exerted on cover 11 due to the weight of cover 11 and the biasing force of spring 45. A positive force means that cover 11 is being forced closed while a negative force indicates cover 11 is being forced open relative to horizontal base 13. As reflected in FIG. 5, approximately 2.8 pounds of force are being exerted on cover 11 in the closed position taking into account the weight of cover 11 and the biasing force of spring 45. Thus, an operator would have to initially impart approximately 2.8 pounds of force to initially move cover 11 toward the fully opened position. As cover 1 is rotated in the clockwise direction about pin 27, the overall force acting on cover 11 gradually decreases until cover 11 has been rotated 12 degrees from the closed position of FIG. 2 (line "A" at 107 degrees and first portion 29 at 17 degrees relative to base 13 ), whereby the sum of the forces acting on cover 11 is approximately zero. In this situation, cover 11 is said to be completely balanced such that it will not move from its position once set therein. A completely balanced position is maintained until cover 11 has been rotated a total of 46 degrees, relative to base 13, at which point the sum of the forces acting on cover 11 tends to push cover 11 toward the fully opened position. A maximum pushing open force of approximately 0.5 pounds is reached when cover 11 has been rotated 48 degrees relative to base 13 and this maximum force is maintained up to the point where cover 11 has been rotated 49 degrees relative to base 13. At 49 degrees of rotation, the sum of the forces acting on cover 11 which tend to push cover 11 toward the fully opened position begins to gradually decrease until neutral balancing is once again reached at the point where cover 11 has been rotated 51 degrees relative to base 13. If cover 11 is moved beyond 51 degrees of rotation toward the fully opened position (at 53 degrees of rotation), the sum of the forces acting on cover 11 is such that it tends to push cover 11 back toward the closed position. The feature whereby the sum of the forces acting on the cover at first tends to push the cover open at 46 degrees of rotation and then tends to push the cover closed 51 degrees of rotation is very important in that it provides a "soft stop" for the cover thereby preventing the slamming open of cover 11 against hard stops incorporated in base 13. Moreover, if cover 11 is rotated beyond 51 degrees and subsequently released, it will ultimately completely balance itself at approximately 51 degrees of rotation.

The invention of the counterbalance device set forth herein provides a very simple structure which can be used to establish any desired force profile. In the preferred embodiment, the desired force profile ensures that the cover does not pop open when in a fully closed position and also prevents cover 11 from slamming fully into the fully opened position. However, depending upon the particular application, a different force profile might be desirable. In this case, one possessing ordinary skill in the art has the capability of creating the desired force profile at any desired position in the range of movement of the cover by taking into account the mass of the cover; the particular extension spring being used including its free length, spring constant, initial load, and maximum load, the position of the center of gravity of the cover relative to the cover pivot axis; the position of the cover pivot axis relative to the base datum; the position of the follower arm pivot axis relative to the base datum, the position of the follower roller relative to the follower arm pivot axis, the position of the extension spring attachment point on the follower arm relative to the follower arm pivot axis, the position of the extension spring attachment point on the cover relative to the cover pivot axis, and the follower roller diameter. Thus, once the specific physical and positional parameters of each of the structural (excluding the cam) components is decided upon, and the pivot axes determined, the cam shape can be designed in order to ensure that the desired force profile acting on the cover is obtained at each and every position of the cover due to the position of the follower roller relative to the cam. That is, since movement by roller arm roller 43 a long cam 33 will result in a positional change in the relationship between the structural components, the shape of cam 33 can be designed to ensure a desired force profile acting on the cover is produced at any position of the cover.

It is noted that while an extension spring is shown, many conventional biasing means could be used in lieu thereof. The structural equivalents of the term "biasing means" as used herein are meant only to include other biasing mechanisms which provide the restoring (counterbalancing) force vie linear extensions or linear compression of the biasing mechanism or by bending of the biasing mechanism (i.e., extension spring, compression spring, leaf spring, hydraulic cylinders, and gas springs ). Moreover, while only a single counterbalance device has been shown in the drawings, a second similar counterbalance device would typically be incorporated on the other side of cover 11 and base 13 such that the forces exerted by each of the counterbalance devices would be taken into account in establishing the desired force profile.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents. For example, instead of follower cam roller 43 the follower arm 45 could include as a portion thereof a non-rolling follower that would slide along the surface of the cam 33. Additionally, the biasing means could-be connected between the follower arm 35 and base 13 to accomplish the counterbalancing effect.

What is claimed is:

1. A counterbalance device for a mail processing system, comprising:

a cover;

a base;

a support arm fixedly mounted to one of said cover and said base and articulately mounted to the other of said cover and said base such that said cover and said base are pivotable relative to each other; and means for counterbalancing said one of said cover and said base to create a predetermined force profile throughout a full range of pivoting movement of said one of said cover and said base from a closed position to a fully opened position relative to the other of said cover and said base, said predetermined force profile representing the net force acting on said one of said cover and said base at each point in said full range of pivoting movement, said counterbalancing means including a cam operatively connected to pivot with said one of said cover and said base, a follower arm pivotally connected to the other of said cover and said base, a roller mounted on said follower arm and a biasing means mounted to pivot with said one of said cover and said base and being connected to said follower arm for biasing said roller against said cam such that during pivoting of said one of said cover and said base through said full range of pivoting movement said roller follows a shape of said cam.

2. A counterbalance device as set forth in claim 1, wherein a sum of the predetermined force profile at any point 1) over a first portion of said full range of pivotal movement and a corresponding force due to the weight of said one of said cover and said base results in said one of said cover and said base being forced toward said closed position, 2) over a second portion of said full range of pivotal movement beyond said first portion is approximately zero, 3) over a third portion of said full range of pivotal movement beyond said second portion forces said one of said cover and said base toward the fully opened position and, 4) over a fourth portion of said full range of pivotal movement beyond said third portion forces said one of said cover and said base toward said closed position.

3. A counterbalance device comprising:

a first part;

a second part;

a support arm fixedly mounted to said first part and articulately mounted to said second part such that said first part pivots with said support arm relative to said second part;

a cam having a cam surface and being slaved to pivot with said support arm relative to said second part;

a follower arm pivotably mounted to said second part;

a follower associated with said follower arm and disposed against said cam surface; and biasing means, fixedly mounted to said first part to pivot therewith and connected to said follower arm, for biasing said follower against said cam surface such that as said cam pivots with said support arm said follower moves along said cam surface whereby said biasing means via said follower, said follower arm, said cam and said support arm imparts a biasing force to counterbalance the effective weight of said first part throughout movement of said first part between a closed position and a fully opened position.

4. A counterbalance device as set forth in claim 3, wherein said cam is integrally formed in said support arm.

5. A counterbalance device as set forth in claim 4, wherein said follower is a roller rotatably mounted to said follower arm.

6. A counterbalance device as set forth in claim 4, wherein said follower is integrally formed as a non-rotable part of said follower arm.

7. A counterbalance device as set forth in claim 4, wherein said biasing means is an extension spring.

8. A counterbalance device as set forth in claim 5, wherein said support arm is pivotably mounted to said second part at a first point spaced apart from a second point at which said follower arm is pivotably mounted to said second part.

9. A counterbalance device as set forth in claim 3, wherein a sum of said biasing force and the effective weight of the first part at each position throughout said movement of the first part between said closed and fully opened positions defines a predetermined force profile, said predetermined force profile including a first portion corresponding to a first angular pivotal movement of said first part whereby the first part is being forced toward the closed position, a second portion corresponding to a second angular pivotal movement of the first part beyond said first angular pivotal movement whereby the first part is completely balanced, a third portion corresponding to a third angular pivotal movement beyond said second angular pivotal movement whereby the first part is forced toward the fully opened position, a fourth portion corresponding to a fourth angular pivotal movement beyond said third angular pivotal movement whereby the first part is balanced, and a fifth portion corresponding to a fifth angular pivotal movement beyond the forth angular pivotal movement whereby said first part is being forced toward the closed position.

10. A counterbalance device as set forth in claim 9, wherein said first angular pivotal movement is 12 degrees, said second angular pivotal movement is 34 degrees, said third angular pivotal movement is 15 degrees, said forth angular pivotal movement is between said third and fifth angular pivotal movements and said fifth angular pivotal movement is 2 degrees.

11. A counterbalance device as set forth in claim 10, wherein said first portion starts at approximately 2.8 lbs. and gradually reduces to zero lbs over said first angular pivotal movement, said second portion is approximately zero lbs. over said second angular pivotal movement, said third portion starts at zero lbs. and gradually changes to −0.5 lbs. over said third angular pivotal movement, said fourth portion is approximately zero lbs. over said fourth angular pivotal movement and said fifth portion gradually changes from zero lbs. to approximately 0.5 lbs. over said fifth angular pivotal movement.

12. A counterbalance device comprising:

a first part;

a second part;

a support arm fixedly mounted to said first part and articulately mounted to said second part such that said first part pivots at a cover pivot point with said support arm relative to said second part;

a cam having a cam surface and being slaved to pivot with said support arm relative to said second part;

a follower arm pivotably mounted to said second part and having a follower thereon disposed against said cam surface; and biasing means, mounted to one of said first and second parts and connected to said follower arm, for biasing said follower against said cam surface such that as said cam pivots with said support arm said follower moves along said cam surface whereby said biasing means via said follower, said follower arm, said cam and said support arm imparts a biasing force to counterbalance the effective weight of said first part throughout movement of said first part between a closed position and a fully opened position.

13. A counterbalance device as set forth in claim 12, wherein said follower is integrally formed as a non-rotatable part of said follower arm.

14. A counterbalance device as set forth in claim 12, wherein said follower is rotatably mounted to said follower arm to roll along said cam surface.

15. A counterbalance device as set forth in claim 12, wherein said biasing means imparts said biasing force via one of a linear extensions thereof, a linear compression thereof and a bending thereof.

16. A counterbalance device as set forth in claim 12, wherein as said cover moves from said closed position to said fully opened position counterbalancing due to said biasing means occurs beyond a cover position in which a center of gravity of the cover is directly over said cover pivot point.

* * * * *